US007681730B2

(12) United States Patent
Cooper et al.

(10) Patent No.: US 7,681,730 B2
(45) Date of Patent: Mar. 23, 2010

(54) PLASTIC FASTENERS, NEEDLES FOR DISPENSING AND METHOD OF MANUFACTURE

(75) Inventors: William J. Cooper, Woonsocket, RI (US); Jeffrey A. Raymond, Leominster, MA (US); Charles L. Deschenes, North Attleboro, MA (US); Daniel Gilbertson, Northbridge, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/343,080

(22) PCT Filed: Jul. 25, 2001

(86) PCT No.: PCT/US01/23451

§ 371 (c)(1),
(2), (4) Date: Aug. 14, 2003

(87) PCT Pub. No.: WO02/08064

PCT Pub. Date: Jan. 31, 2002

(65) Prior Publication Data

US 2004/0031838 A1 Feb. 19, 2004

Related U.S. Application Data

(63) Continuation-in-part of application No. 09/740,700, filed on Dec. 19, 2000, now Pat. No. 6,564,939, which is a continuation-in-part of application No. 09/625,334, filed on Jul. 25, 2000, now Pat. No. 6,427,895.

(51) Int. Cl.
*B65D 85/24* (2006.01)

(52) U.S. Cl. ..... 206/343; 206/820

(58) Field of Classification Search ..... 206/338, 206/343, 345, 346, 820, 340; 24/298, 300; 227/73

See application file for complete search history.

(56) References Cited

U.S. PATENT DOCUMENTS

| | | | | | |
|---|---|---|---|---|---|
| 3,875,648 | A | * | 4/1975 | Bone | 227/67 |
| 3,990,619 | A | | 11/1976 | Russell | |
| 4,039,078 | A | | 8/1977 | Bone | |
| 4,288,017 | A | * | 9/1981 | Russell | 227/67 |
| 4,392,906 | A | | 7/1983 | Hara | |
| 4,456,161 | A | | 6/1984 | Russell | |
| 5,042,558 | A | * | 8/1991 | Hussey et al. | 148/530 |
| 5,076,480 | A | * | 12/1991 | Bone et al. | 227/67 |
| 5,305,939 | A | | 4/1994 | Deschenes et al. | |

(Continued)

*Primary Examiner*—J. Gregory Pickett
(74) *Attorney, Agent, or Firm*—Kriegsman & Kriegsman

(57) ABSTRACT

A needle (51) particularly well-suited for use in the dispensing of plastic fasteners (21) of the type comprising a filament (15) having a cross-bar (23-1, 23-2) at a first end thereof, each of the cross-bar (23-1, 23-2) and the filament (15) including a first flat side, the first flat sides of the cross-bar (23-1, 23-2) being coplanar. The needle (51) includes a stem portion (53). The stem portion (53) terminates in a tip (57) at its front end and is shaped to define a longitudinal bore (59) and a longitudinal slot (61) for receiving the filament (15) and the cross-bar (23-1, 23-2). The longitudinal bore (59) has a first flat side, and the longitudinal slot (61) has a first flat side, wherein the flat sides are coplanar.

7 Claims, 8 Drawing Sheets

U.S. PATENT DOCUMENTS 5,307,975 A 5/1994 Deschenes et al.
5,489,057 A 2/1996 Deschenes
5,575,713 A 11/1996 Benoit et al.
6,009,997 A 1/2000 Deschenes et al.
6,064,306 A 5/2000 Deschenes et al.
6,318,553 B1 * 11/2001 Deschenes ..... 206/343

* cited by examiner

PLASTIC FASTENERS, NEEDLES FOR DISPENSING AND METHOD OF MANUFACTURE

CROSS-REFERENCE TO RELATED APPLICATIONS

The present application is a continuation-in-part of U.S. patent application Ser. No. 09/740,700, filed Dec. 19, 2000, now U.S. Pat. No. 6,564,939 in the names of Charles L. Deschenes and Daniel Gilbertson, and is also a continuation-in-part of U.S. patent application Ser. No. 09/625,334, filed Jul. 25, 2000, in the name of Charles L. Deschenes, now U.S. Pat. No. 6,427,895.

BACKGROUND OF THE INVENTION

The present invention relates to the dispensing of plastic fasteners of the type that are used, for example, to attach tags to articles of commerce.

Plastic fasteners of the type comprising an elongated flexible filament having a first cross-bar at one end and a second cross-bar (or other enlargement, such as a paddle or a knob) at the opposite end are well-known and have been widely used in a variety of applications, such as in the attachment of merchandise tags to articles of commerce, in the attachment of buttons to garments, in the lasting of shoes, and in various packaging applications. Typically, such plastic fasteners are mass-produced by molding processes into either one of two different types of assemblies. One such assembly, an example of which is disclosed in U.S. Pat. No. 3,103,666, inventor Bone, issued Sep. 17, 1963 (which patent is incorporated herein by reference), is a clip-type assembly, said clip comprising a plurality of fasteners, each such fastener comprising a flexible filament having a first cross-bar at one end thereof and a paddle or second cross-bar at the opposite end thereof. The fasteners are arranged in a spaced, side-by-side orientation, with the respective first cross-bars parallel to one another and the respective paddles or second cross-bars parallel to one another, each of the first cross-bars being joined to a common, orthogonally-disposed runner bar by a severable connector. Adjacent second cross-bars or paddles also may be interconnected by severable connectors extending therebetween.

The aforementioned fastener clip is typically made by injection molding. Several commercial embodiments of the above-described fastener clip have been sold by the present assignee, Avery Dennison Corporation, as DENNISON® SWIFTACH® fastener clips.

A second type of fastener assembly, an example of which is disclosed in U.S. Pat. No. 4,533,076, inventor Bourque, issued Aug. 6, 1985 (which patent is incorporated herein by reference), is known as continuously connected fastener stock. In one type of continuously connected stock, the fasteners comprise a flexible filament having a cross-bar at one end thereof and a paddle (or second cross-bar) at the opposite end thereof, the respective cross-bars and paddles of successive fasteners being arranged end-to-end and being joined together by severable connectors. In another type of continuously connected fastener stock, the fastener stock is formed from two elongated and continuous side members coupled together by a plurality of cross-links equidistantly-spaced apart by a distance of 0.25 inch. Individual fasteners having an H-shape, often referred to as "plastic staples," are dispensed from the fastener stock by cutting the side members at appropriate points between cross-links, thereby yielding individual fasteners having cross-bars of 0.25 inch in length.

Continuously connected fastener stock is typically made by a rotary extrusion process of the type disclosed in U.S. Pat. No. 4,462,784, inventor Russell, which issued Jul. 31, 1984, and which is incorporated herein by reference. Said rotary extrusion process typically involves the use of a rotating molding wheel whose periphery is provided with molding cavities that are complementary in shape to the desired fastener stock. To form fasteners, plastic is extruded into the cavities of the molding wheel, and a knife in substantially elliptical contact with the wheel is used to skive the molded plastic from the molding wheel. Following molding, the filament portions of the fasteners are typically stretched.

One consequence of the rotary extrusion process described above, particularly the skiving step thereof, is that the first cross-bar, the filament, and the second cross-bar (or paddle) are flat on one side thereof, with the flattened sides of the first cross-bar, the filament and the second cross-bar all lying in the same plane (see e.g., FIG. 1B of U.S. Pat. No. 4,462,784). The opposite sides of the first-cross bar, the filament, and the second cross-bar (or paddle) conform to the shapes of the molding cavities and are typically not flat. In the case of the first cross-bar, its opposite side is curved, thereby resulting in a cross-bar whose transverse cross-section has a shape resembling a semicircle or semi-ellipse.

Tools (often referred to as "tagging guns" or "fastener attaching tools") for dispensing individual fasteners from continuously connected fastener stock above are known, examples of such tools being disclosed in the following U.S. patents, all of which are incorporated herein by reference: U.S. Pat. No. 4,039,078, inventor Bone, which issued Aug. 2, 1977; U.S. Pat. No. 5,433,366, inventors Deschenes et al., which issued Jul. 18, 1995; U.S. Pat. No. 4,121,487, inventor Bone, which issued Oct. 24, 1978; U.S. Pat. No. 5,320,269, inventors Deschenes et al., which issued Jun. 14, 1994; U.S. Pat. No. 4,955,475, inventors McCarthy et al., which issued Sep. 11, 1990; U.S. Pat. No. 4,456,161, inventor Russell, which issued Jun. 26, 1984; U.S. Pat. No. 5,024,365, inventor Bourque, which issued Jun. 18, 1991; and U.S. Pat. No. 4,998,661, inventors Deschenes et al., which issued Mar. 12, 1991.

Such tools typically comprise a needle, the needle typically including a stem portion. The stem portion typically is generally cylindrical in shape and has a longitudinally-extending, cylindrically-shaped bore adapted to receive the first cross-bar of a fastener. In addition, said stem portion also typically has a longitudinally-extending slot adapted to permit the filament portion of a fastener to extend therethrough while the first cross-bar of the fastener is disposed in the longitudinal bore of the stem portion. The stem portion also typically has a tip adapted for insertion into a desired article of commerce. The needle also may include a base portion, said base portion being attached to the rear of the stem portion and being adapted to be removably received in the tool. The stem portion and the base portion may be a unitary structure or, as is more often the case, the base portion is insert-molded onto the rear end of the stem portion.

Such tools also typically comprise an ejector rod for ejecting a first cross-bar from the needle and into the article of commerce and may also include a knife or similar severing means for cutting the severable connector between the first cross-bar being dispensed and its adjacent first cross-bar and feeding means for advancing the assembly of fasteners in the tool so as to align the forwardmost first cross-bar with the needle.

One problem that has been noted by the present inventor with respect to the dispensing of continuously connected fastener stock of the type described above using needles of the type described above is that, whereas the longitudinal bore and the longitudinal slot together have a symmetric transverse cross-sectional shape resembling an inverse lollipop (the longitudinal bore being circular in transverse cross-section, the longitudinal slot being rectangular in transverse cross-section and bisecting said longitudinal bore at the top thereof), the first cross-bar and the filament together have a "d"-shaped cross-section. As a result, a considerable portion of the transverse cross-section of the longitudinal bore is not occupied by any of the first cross-bar. Because the needle has a circular transverse cross-sectional shape, the effect of the bore being larger in cross-sectional shape than the fastener is that the needle has an outer width or diameter that is larger than that required by the fastener. Consequently, the needle creates an insertion hole in the article of commerce that is greater than that required by the fastener. Because it is desirable to minimize the size of the insertion hole (to minimize damage to the article), the outcome described above is undesirable.

In addition, because a considerable portion of the transverse cross-sectional area of the bore is not occupied by the cross-bar, proper engagement of the cross-bar by the ejector rod and proper translational movement of the cross-bar through the length of the bore due to action of the ejector rod is not always achieved. This results in occasional malfunctioning of the tool.

SUMMARY OF THE INVENTION

It is an object of the present invention to provide a new needle useful in the dispensing of plastic fasteners of the type having a flexible filament and a cross-bar at a first end thereof.

It is another object of the present invention to provide a needle as described above that overcomes at least some of the problems described herein with respect to existing needles.

According to one aspect of the invention, there is provided a needle useful in dispensing plastic fasteners of the type comprising a filament having a cross-bar at a first end thereof, said needle comprising a stem portion, said stem portion terminating in a tip at a front end thereof and being shaped to define a longitudinally-extending bore and a longitudinally-extending slot, said longitudinally-extending bore being dimensioned to receive said cross-bar, said longitudinally-extending slot being dimensioned to permit said filament to extend therethrough while said cross-bar is disposed within said longitudinally-extending bore, said longitudinally-extending bore having a first flat side, said longitudinally-extending slot having a first flat side, said first flat sides of said longitudinally-extending bore and said longitudinally-extending slot being coplanar.

As can readily be appreciated, the aforementioned needle is particularly well-suited for use with plastic fasteners wherein each of the filament and the cross-bar has a flat side and wherein said flat sides are coplanar. Examples of such fasteners include fasteners formed as part of continuously connected fastener stock made by rotary extrusion, such as plastic staples. Where plastic staples of the type comprising a filament and a cross-bar that collectively have a "d"-shape are to be dispensed using the needle of the present invention, the longitudinally-extending bore and the longitudinally-extending slot of the stem portion of the needle preferably collectively have a complementary "d"-shaped transverse cross-section. Depending upon the particular transverse cross-sectional shape of the cross-bar, the longitudinally-extending bore may have a generally semi-elliptical transverse cross-sectional shape, a generally rectangular transverse cross-sectional shape, a generally B-shaped transverse cross-sectional shape, a generally wedge-shaped transverse cross-sectional shape or a like complementary transverse cross-sectional shape. The stem portion of the needle is preferably made of a steel or boron/nickel alloy and is preferably fabricated using electroforming. The needle preferably further comprises a base portion, said base portion being insert-molded onto a rear end of said stem portion.

According to another aspect of the invention, there is provided a needle useful in dispensing plastic fasteners of the type comprising a filament having a cross-bar at a first end thereof, said needle comprising a stem portion, said stem portion terminating at a front end thereof in a tip, said stem portion having a longitudinally extending slotted bore, said longitudinally extending slotted bore having a flat side in transverse cross-section.

The aforementioned needle may be used with a variety of plastic staples or other plastic fasteners wherein each of the filament and the cross-bar has a flat side and wherein said flat sides are coplanar. An example of such a fastener is a plastic staple wherein the filament and the cross-bar have coplanar flat sides and wherein the cross-bar has a "B"-shape in transverse cross-section. The needle preferably has a slotted bore that is complementary in shape to the cross-bar and filament of the fastener.

The present invention is also directed to a novel method of fabricating a needle well-suited for use in the dispensing of plastic fasteners of the type comprising a filament having a cross-bar at a first end thereof. According to one aspect of the present invention, such a method comprises the steps of (a) fabricating an unfinished stem portion, said fabricating step comprising electroforming a metal onto a master, said master having a "d"-shaped transverse cross-section, and then removing the master from the electroformed metal; and (b) finishing said unfinished stem portion, said finishing step comprising machining the unfinished stem portion to yield a finished stem portion, said finished stem portion terminating in a tip at a front end and being shaped to define a longitudinally-extending bore and a longitudinally-extending slot, said longitudinally-extending bore being shaped to receive said cross-bar, said longitudinally-extending slot being shaped to permit said filament to extend therethrough while said cross-bar is disposed within said longitudinally-extending bore, said longitudinally-extending bore and said longitudinally-extending slot collectively having a "d"-shaped transverse cross-section.

As can readily be appreciated, the needle made by the aforementioned method is particularly well-suited for use with plastic staples and other plastic fasteners wherein the filament and the cross-bar collectively have a generally "d"-shaped longitudinal cross-section (said cross-section being defined as being along the longitudinal axis of the filament and perpendicular to the longitudinal axis of the cross-bar). Preferably, the metal of the aforementioned method is a steel or boron/nickel alloy, and said electroforming step preferably comprises depositing metal onto said master to a thickness of about 0.003-0.005 inch. The above-described method preferably further comprises insert-molding a base portion onto a rear end of the finished stem portion.

It should be readily understood that, by selecting an appropriately shaped master, one can adapt the above-described needle fabrication method to make a needle particularly well-suited for use with a fastener whose filament and cross-bar have a coplanar flat side and whose cross-bar is "B"-shaped in transverse cross-section or to make a needle particularly well-suited for use with a fastener whose filament and cross-bar have a coplanar flat side and whose cross-bar is shaped to include one or more humps.

The present invention is also directed to a combination of a plastic fastener and a needle. In one embodiment, said plastic fastener comprises a flexible filament having a cross-bar at a first end thereof, said cross-bar and said flexible filament collectively having a generally "d"-shaped longitudinal cross-section, said needle comprising a stem portion, said stem portion terminating in a tip at a front end thereof and being shaped to define a longitudinally-extending bore and a longitudinally-extending slot, said longitudinally-extending bore being dimensioned to receive said cross-bar, said longitudinally-extending slot being dimensioned to permit said flexible filament to extend therethrough while said cross-bar is disposed within said longitudinally-extending bore, said longitudinally-extending bore and said longitudinally-extending slot collectively having a generally "d"-shaped transverse cross-section.

Preferably, the fastener cross-bar of the aforementioned combination is generally semi-elliptical in transverse cross-sectional shape or is generally rectangular in transverse cross-sectional shape. In a particularly preferred embodiment, the cross-bar is generally rectangular in transverse cross-sectional shape and has a transverse cross-sectional height and a transverse cross-sectional width, said transverse cross-sectional height being greater than said transverse cross-sectional width and being parallel to the length of said flexible filament.

In another embodiment, said plastic fastener comprises a flexible filament having a cross-bar at a first end thereof, each of said cross-bar and said flexible filament having a flat side, said flat sides being coplanar, said cross-bar being generally "B"-shaped in transverse cross-section, said needle comprising a stem portion, said stem portion terminating in a tip at a front end thereof and being shaped to define a longitudinally-extending bore and a longitudinally-extending slot, said longitudinally-extending bore and said longitudinally-extending slot being complementarily shaped to said plastic fastener.

The present invention is also directed to a novel plastic fastener. In one embodiment, said plastic fastener comprises a flexible filament having a cross-bar at a first end thereof, said cross-bar and said flexible filament collectively having a generally "d"-shaped cross-section taken along the length of said flexible filament and transverse to the length of said cross-bar, said cross-bar having a substantially rectangular cross-sectional shape with its transverse length being larger than its transverse width.

In another embodiment, said plastic fastener comprises a flexible filament having a cross-bar at a first end thereof, said cross-bar having a flat side and being generally "B"-shaped in transverse cross-section. Preferably, said flexible filament also has a flat side, said flat side of said flexible filament and said flat side of said cross-bar being coplanar.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
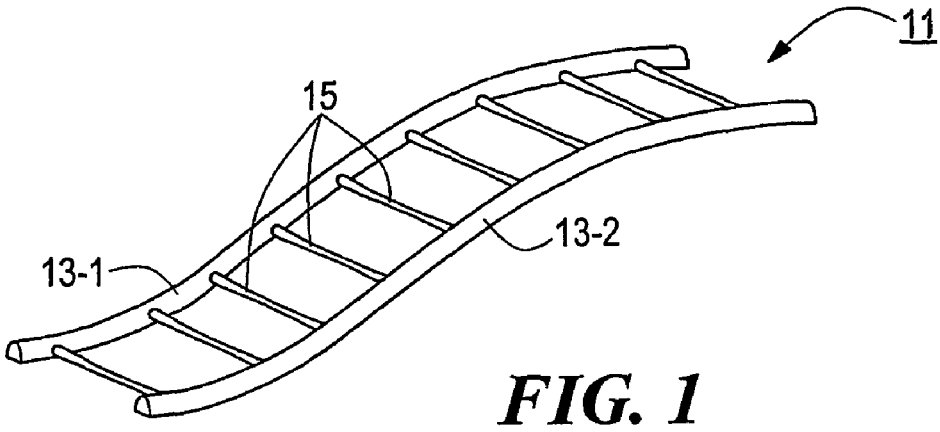
FIG. 1 is a perspective view of a length of conventional continuously connected fastener stock of the plastic staple variety.

Referring now to FIG. 1, there is shown a perspective view of a length of conventional continuously connected fastener stock of the plastic staple variety, said length of fastener stock being represented generally by reference numeral 11.

Fastener stock 11, which is made by the above-described rotary extrusion method and is typically made of polyurethane, comprises two elongated and continuous side members 13-1 and 13-2. Side members 13-1 and 13-2 are coupled together by a plurality of flexible cross-links or filaments 15, cross-links 15 being equidistantly-spaced apart by a distance of 0.25 inch. By cutting side members 13-1 and 13-2 at appropriate points between cross-links 15, individual fasteners having an H-shape, often referred to as "plastic staples," are produced. Each of the cross-bars of an individual plastic staple has a length of 0.25 inch.

Figure 2:
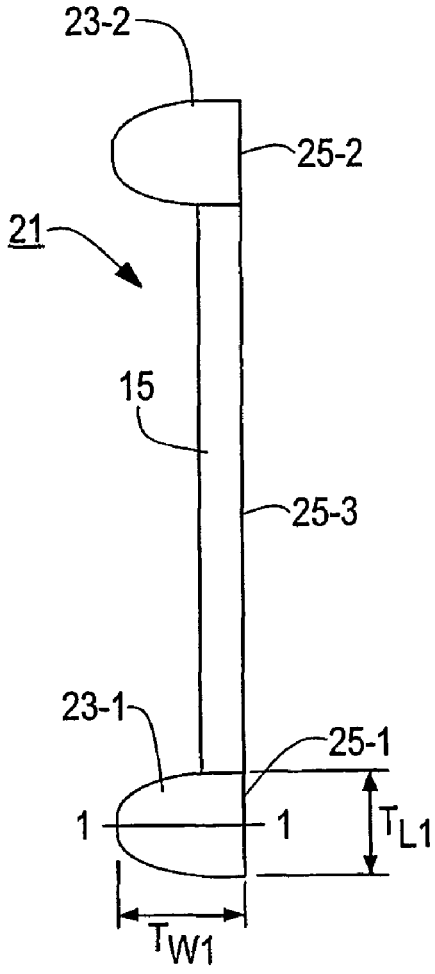
FIG. 2 is an enlarged end view of an individual plastic staple obtained from the length of conventional continuously connected fastener stock of FIG. 1.

Referring now to FIG. 2, there is shown an enlarged end view of an individual plastic staple obtained in the aforementioned manner from a length of fastener stock 11, the individual plastic staple being represented generally by reference numeral 21.

Staple 21 comprises a first cross-bar 23-1, which has been cut from side member 13-1, and a second cross-bar 23-2, which has been cut from side member 13-2, cross-bars 23-1 and 23-2 being interconnected by flexible filament 15. As can be seen, due to the rotary extrusion process by which stock 11 is formed, cross-bars 23-1 and 23-2 and filament 15 are flat on sides 25-1, 25-2 and 25-3, respectively, sides 25-1, 25-2 and 25-3 being coplanar with one another. As a result, as can be seen, cross-bar 23-1 and filament 15 collectively have a generally "d"-shape when viewed from an end, with cross-bar 23-1 having a substantially semi-oval shape in cross-section and being generally symmetric about line 1-1. Cross-bar 23-1 has a transverse width $Tw_1$ greater than its transverse length $Tl_1$. Cross-bar 23-2 and filament 15 also collectively have a generally "d"-shape when viewed from an end, with cross-bar 23-2 being sized and shaped identically to cross-bar 23-1.

Figure 3:
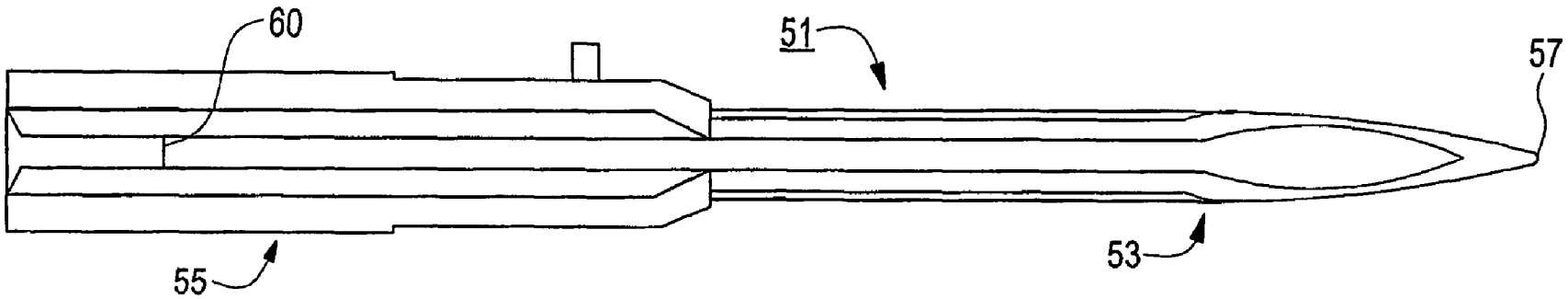
FIG. 3 is a top view of a conventional needle adapted for use in dispensing fasteners, such as the plastic staple of FIG. 2.
Figure 4:
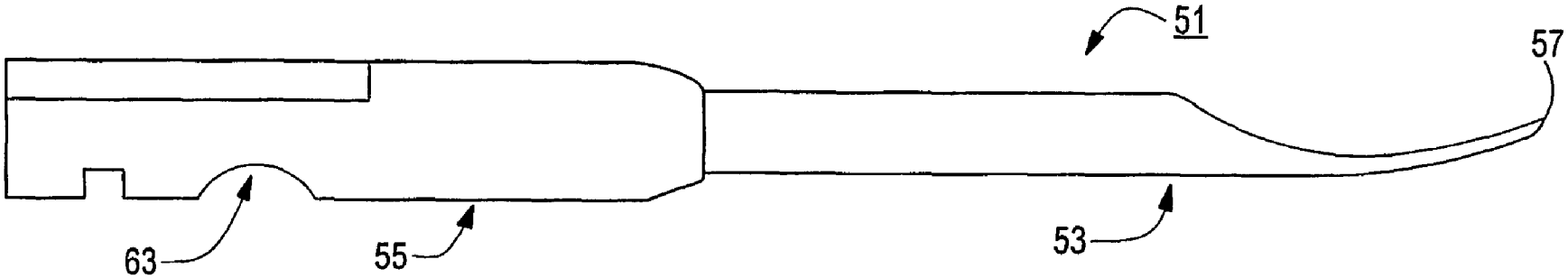
FIG. 4 is a left side view of the needle shown in FIG. 3.

Referring now to FIGS. 3 and 4, there are shown top and left side views, respectively, of a conventional needle adapted for use in dispensing fasteners, such as the plastic staple of FIG. 2, said needle being represented generally by reference numeral 51.

Needle 51 comprises a stem portion 53 and a base portion 55. Stem portion 53 may be made, for example, by stamping and rolling or by machining a piece of metal (e.g., stainless steel) or by the electroforming/machining technique described in U.S. Pat. No. 5,489,057, inventor Deschenes, issued Feb. 6, 1996, the disclosure of which is incorporated herein by reference.

Figure 5:
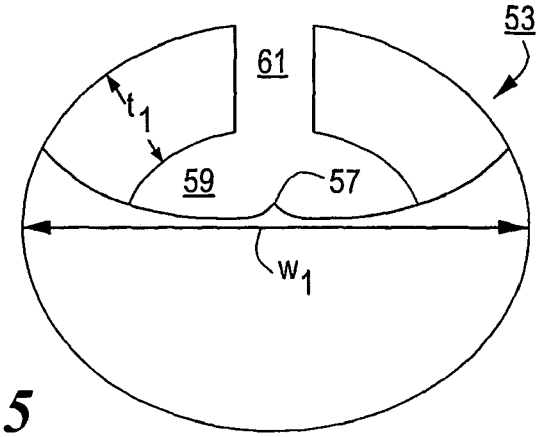
FIG. 5 is a front view of the stem portion of the needle shown in FIG. 3.

Referring now to FIGS. 3 through 5, stem portion 53 can be seen to be an elongated member that is substantially cylindrical over most of its length (and annular in transverse cross-section). The front end of stem portion 53 is formed into a spoon-shaped tip 57, tip 57 being sufficiently sharp to enable its penetration into a desired article of commerce. A generally cylindrical bore 59 extends longitudinally across substantially the entire length of stem portion 53. Bore 59 is appropriately dimensioned to receive a cross-bar of a plastic fastener, such as cross-bar 23-1 of plastic staple 21. Stem portion 53 is also shaped to include a slot 61 extending longitudinally across substantially the entire length of stem portion 53, slot 61 being appropriately dimensioned to permit a filament, such as filament 15, to extend therethrough while its associated cross-bar is disposed within bore 59.

A conventional stamped and rolled stainless steel stem portion 53 used in the dispensing of plastic staples 21 typically has a width $w_1$, of about 0.065 inch and a cross-sectional thickness $t_1$ of about 0.008-0.010 inch.

Referring back to FIGS. 3 and 4, base portion 55 is made in the conventional manner by insert-molding plastic onto the rear end 60 of stem portion 53. Base portion 55, which is generally cylindrical in shape, includes a generally cylindrically-shaped longitudinal bore aligned with (and sized similarly to) bore 59 of stem portion 53 and also includes a longitudinal slot aligned with (and sized similarly to) slot 61 of stem portion 53. Base portion 55 is provided with a recessed area 63 for use in correctly positioning needle 51 within a fastener dispensing tool and for locking the same into place.

Figure 6:
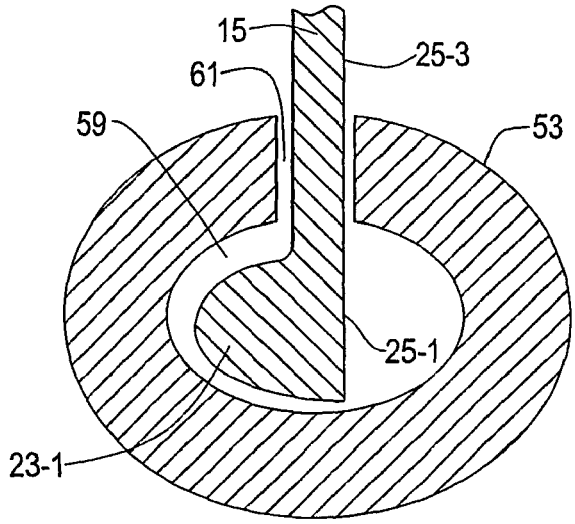
FIG. 6 is a transverse section view of the stem portion of the needle of FIG. 3, the plastic staple of FIG. 2 being disposed therewithin.

Referring now to FIG. 6, there is shown a transverse section view of stem portion 53, with plastic staple 21 being loaded therein. As described above, the present inventor has noted that, because filament 15 and cross-bar 23-1 are flat on sides 25-3 and 25-1, respectively, whereas bore 59 is circular in transverse cross-section and slot 61 bisects bore 59 from the top thereof, a considerable portion of bore 59 is left unoccupied by staple 21. Consequently, because bore 59 is larger than necessary to hold staple 21, the overall size or width $w_1$ of stem portion 53 is unnecessarily large, thereby leading to an insertion hole created by stem portion 53 that is larger than needed. In addition, because cross-bar 23-1 is much smaller than bore 59 and has considerable freedom to move laterally within bore 59, the proper translational movement of cross-bar 23-1 through bore 59 during ejection cannot be assured.

Figure 7:
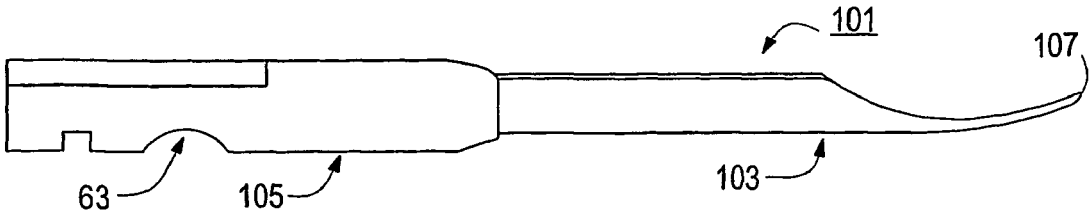
FIG. 7 is a side view of a first embodiment of a needle constructed according to the teachings of the present invention.

Referring now to FIG. 7, there is shown a left side view of a first embodiment of a needle constructed according to the teachings of the present invention, the needle being represented generally by reference numeral 101.

Needle 101 comprises a stem portion 103 and a base portion 105. Base portion 105, which is identical in all respects to base portion 55, may be made by insert-molding plastic onto the rear end of stem portion 103.

Figure 8:
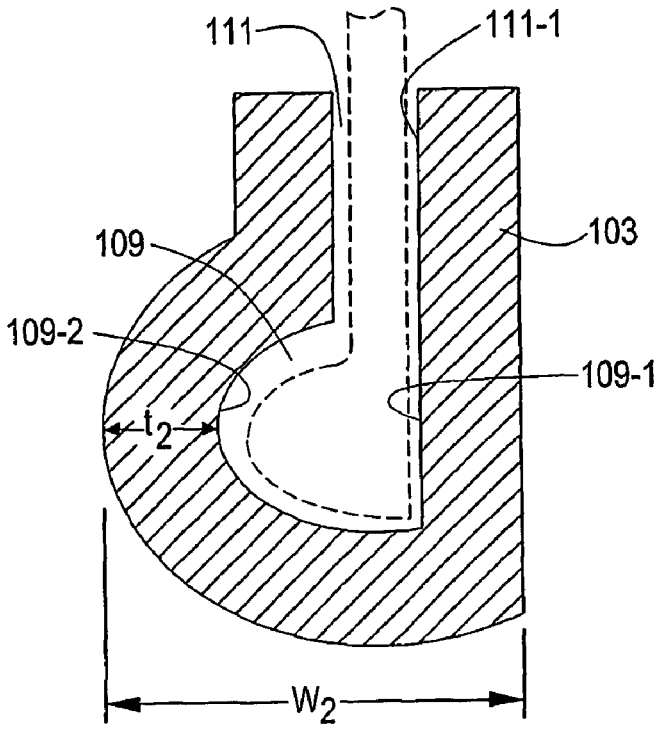
FIG. 8 is a transverse section view of the stem portion of the needle of FIG. 7, a conventional plastic staple being shown disposed therein in phantom.

Stem portion 103 is similar in certain respects to stem portion 53. For example, stem portion 103 is an elongated member terminating at its front end in a spoon-shaped tip 107, tip 107 being sufficiently sharp to enable its penetration into a desired article of commerce. However, as shown in FIG. 8, stem portion 103 differs markedly from stem portion 53 in that stem portion 103 has a generally "d"-shaped transverse cross-section, instead of the generally annular transverse cross-section of stem portion 53. As such, stem portion 103 defines a generally semi-elliptical bore 109 and a generally rectangular slot 111, bore 109 and slot 111 communicating with one another and extending longitudinally across substantially the entire length of stem portion 103. Bore 109 is bounded on one side thereof by a flat side 109-1 and is bounded on its opposite side by a curved or "single-humped" side 109-2. Slot 111-1 is bounded one on side thereof by a flat side 111-1, flat sides 109-1 and 111-1 lying in the same plane and forming a single continuous wall. Bore 109 is appropriately dimensioned to receive a cross-bar of a plastic fastener, such as cross-bar 23-1 of plastic staple 21, and slot 111 is appropriately dimensioned to permit a filament, such as filament 15, to extend therethrough while its associated cross-bar is disposed within bore 109.

As can be seen in FIG. 8, because the shape of stem portion 103 more closely conforms to that of staple 21, the amount of unoccupied or wasted space in bore 109 is considerably less than that in bore 59, and the overall size or width $w_2$ of stem portion 103 can be made to be smaller than that for stem portion 53. Moreover, because of the truncated shape of bore 109, cross-bar 23-1 has much less freedom to move laterally within bore 109 as it is being ejected therefrom. Furthermore, because slot 111 is shaped so as to surround comparatively more of the length of filament 15 than does slot 61, staple 21 is afforded increased protection against becoming broken in the vicinity of the juncture between filament 15 and cross-bar 23-1.

Stem portion 103 may be made by extrusion or by any of the same techniques discussed above in connection with the fabrication of stem portion 53; however, the above-described electroforming/machining technique is preferred. Said electroforming step is preferably performed using a suitably shaped master (e.g., a "d"-shaped master) and preferably involves depositing a boron/nickel (or steel) alloy onto the master to a substantially uniform thickness of about 0.003-0.005 inch. One of the advantages of using electroforming and the aforementioned boron/nickel alloy to form stem portion 103 is that the cross-sectional thickness $t_2$ of stem portion 103 can be kept smaller than that for stem portion 53 (i.e., about 0.003-0.005 inch versus about 0.008-0.010 inch), without a concurrent loss in strength (or even with an improvement in strength). This reduction in the cross-sectional thickness of stem portion 103, together with the truncated shape of stem portion 103, permits the overall size or width $w_2$ of stem portion 103 to be kept to a minimum (e.g., about 0.050 inch for stem portion 103 versus about 0.065 inch for stem portion 53).

Figure 9:
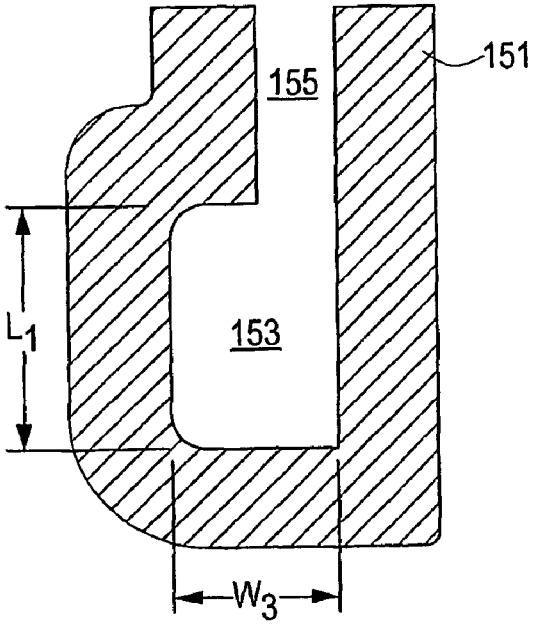
FIG. 9 is a transverse section view of a second embodiment of a stem portion of a needle constructed according to the teachings of the present invention.

Referring now to FIG. 9, there is shown a transverse section view of a second embodiment of a stem portion of a needle constructed according to the teachings of the present invention, the stem portion being represented generally by reference numeral 151.

Stem portion 151 is identical in virtually all respects to stem portion 103, the principal difference between stem portion 151 and stem portion 103 being that stem portion 151 is shaped to define a generally rectangular bore 153, instead of the generally semi-elliptical bore 109 of stem portion 103. Bore 153 has a transverse cross-sectional height $h_1$ and a transverse cross-sectional width $w_3$, height $h_1$ being greater than width $w_3$ and extending parallel to the length of a filament in slot 155.

Stem portion 151 is preferably made in the same manner as stem portion 103, and a suitably shaped base portion (not shown) is preferably insert-molded onto the rear end of stem portion 151 in the conventional manner.

Figure 10:
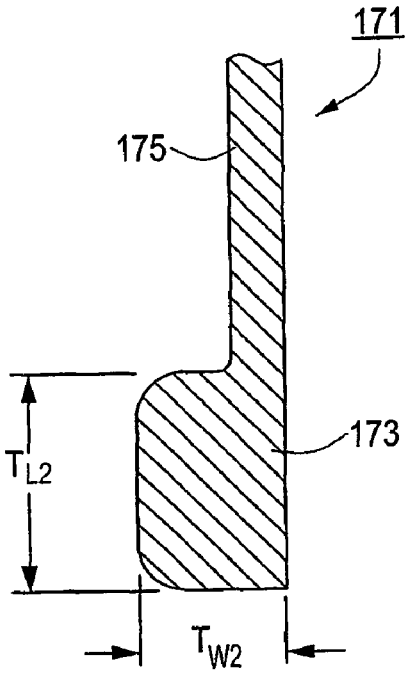
FIG. 10 is a fragmentary section view of a plastic fastener adapted for use in a needle comprising the stem portion of FIG. 9.

Because of the generally rectangular transverse cross-sectional shape of bore 153, stem portion 151 is particularly well-suited for use with a plastic fastener having a complementary generally rectangular cross-sectional shape. An example of such a fastener is shown in FIG. 10 and is represented generally by reference numeral 171. As compared to cross-bar 23-1, cross-bar 173 of fastener 171 has a substantially rectangular cross-section, rather than a substantially semi-oval shaped cross-section, and has a comparatively increased transverse cross-sectional length $Tl_2$ and a comparatively decreased transverse cross-sectional width $Tw_2$, with length $Tl_2$ being larger than width $Tw_1$. The overall masses of cross-bar 23-1 and cross 173 are generally equivalent. The increased transverse cross-sectional height endows cross-bar 173 with increased strength to resist collapsing towards its midpoint and being withdrawn through an article when a withdrawing force is applied to filament 175 (a phenomenon known in the art as "Y"-ing).

Figure 11:
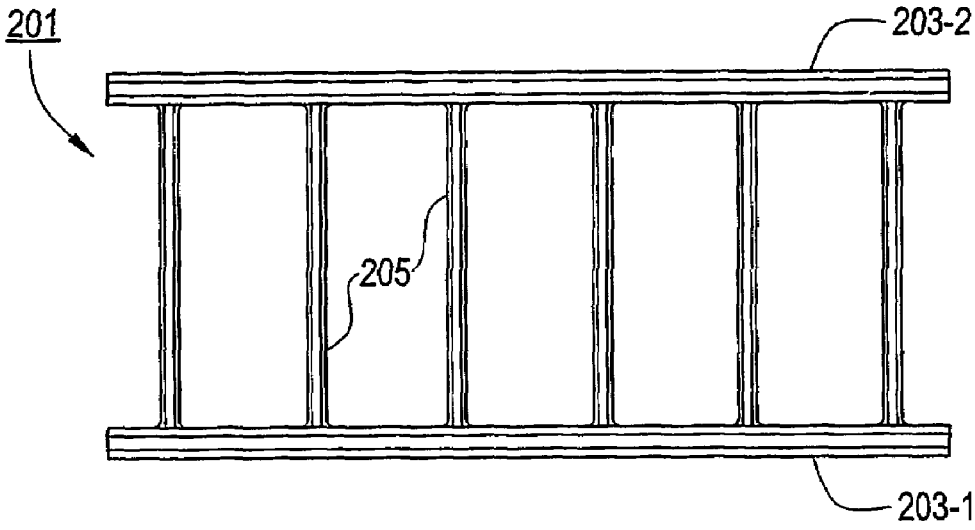
FIG. 11 is a side view of a first embodiment of a length of plastic staple stock constructed according to the teachings of the present invention.
Figure 12:
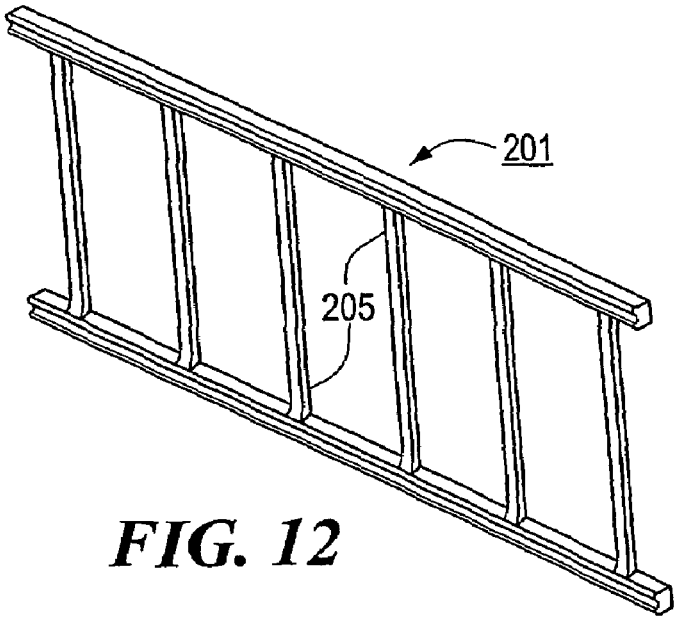
FIG. 12 is a perspective view of the length of plastic staple stock shown in FIG. 11.

Referring now to FIGS. 11 and 12, there are shown side and perspective views, respectively, of a first embodiment of a length of plastic staple stock constructed according to the teachings of the present invention, said length of plastic staple stock being represented generally by reference numeral 201.

Stock 201, which is preferably made a rotary extrusion method of the type described above and which is preferably made of polyurethane or the like, comprises two elongated and continuous side members 203-1 and 203-2. Side members 203-1 and 203-2 are coupled together by a plurality of flexible cross-links or filaments 205, cross-links 205 being equidistantly-spaced apart by a distance of about 0.18 inch. By cutting side members 203-1 and 203-2 at appropriate points between cross-links 205, individual fasteners having an overall H-shape and a cross-bar length of about 0.18 inch are produced. One advantage of stock 201 having a pitch of about 0.18 inch, as opposed to the 0.25 pitch of stock 11, is that the number of fasteners per unit length of stock is greater in stock 201 than in stock 11, thereby permitting more fasteners to be fitted to a length of stock 201 than to a comparable length of stock 11. One would not want to further reduce the pitch of the stock much more beyond 0.18 inch (i.e., in the vicinity of 0.1 inch) since, for many applications, a cross-bar much shorter than about 0.18 inch is too short to be retained in an item and will too easily be withdrawn through the item when subjected to a substantial withdrawal force.

Figure 13:
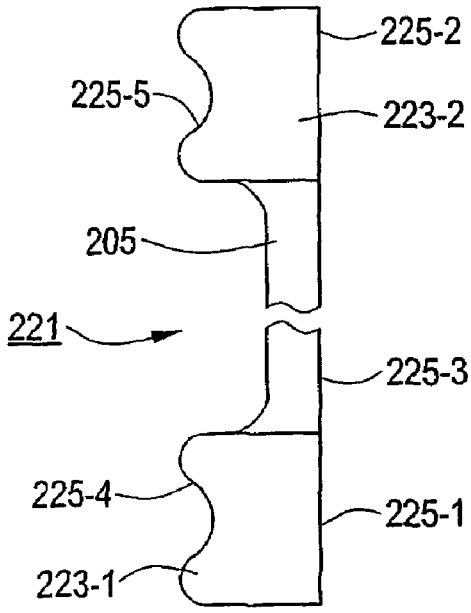
FIG. 13 is a fragmentary enlarged end view of an individual plastic staple obtained from the length of plastic staple stock of FIG. 11.

Referring now to FIG. 13, there is shown a fragmentary enlarged end view of an individual plastic staple obtained in the aforementioned manner from a length of fastener stock 201, the individual plastic staple being represented generally by reference numeral 221.

Staple 221 comprises a first cross-bar 223-1, which has been cut from side member 203-1, and a second cross-bar 223-2, which has been cut from side member 203-2, cross-bars 223-1 and 223-2 being interconnected by flexible filament 205. As can be seen, due to the rotary extrusion process by which stock 201 is formed, cross-bars 223-1 and 223-2 and filament 205 are flat on sides 225-1, 225-2 and 225-3, respectively, with sides 225-1, 225-2 and 225-3 being coplanar with one another. As can also be seen, cross-bars 223-1 and 223-2 are shaped to include a pair of protrusions or humps on sides 225-4 and 225-5, respectively. Consequently, each of cross-bars 223-1 and 223-2 has a generally "B"-shape when viewed from the ends thereof.

Figure 14:
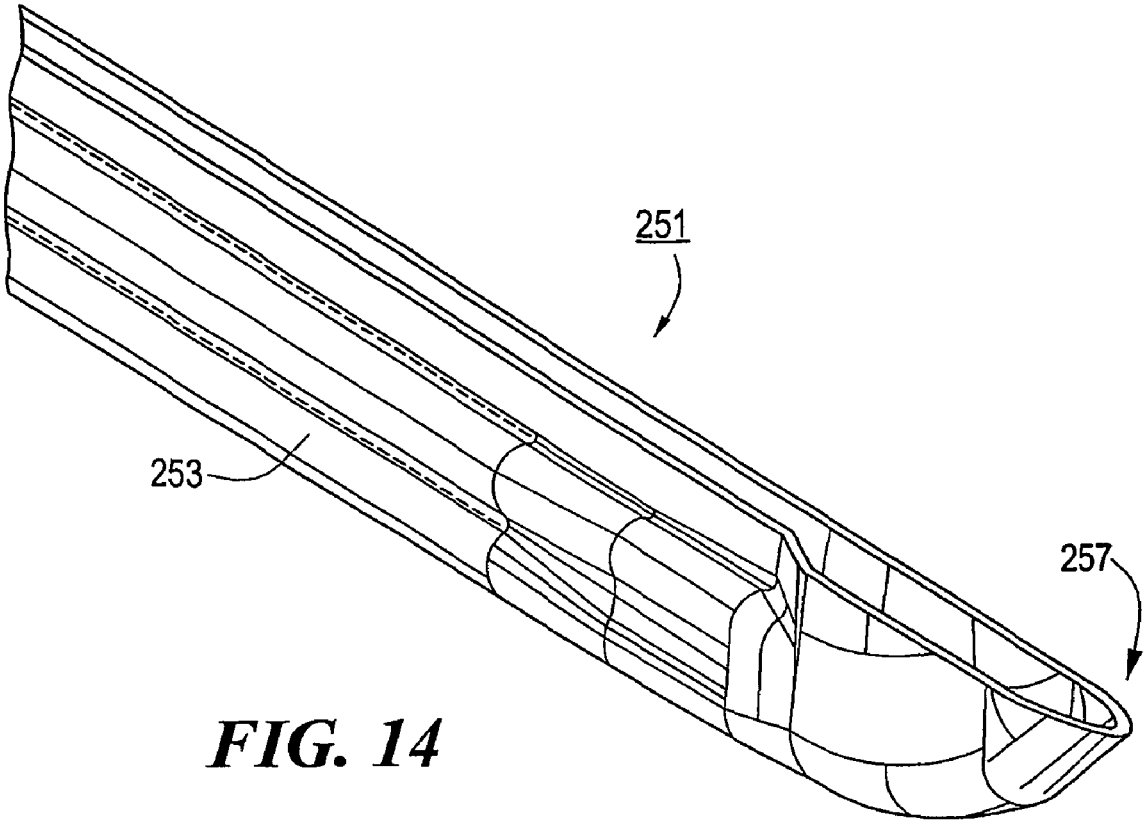
FIG. 14 is a fragmentary perspective view of a third embodiment of a needle constructed according to the teachings of the present invention, said needle being adapted for use with the plastic staple of FIG. 13.

Referring now to FIG. 14, there is shown a fragmentary perspective view of a third embodiment of a needle constructed according to the teachings of the present invention, said needle being represented generally by reference numeral 251.

Needle 251 comprises a stem portion 253 and a base portion (not shown), said base portion being similar to base portion 55 and preferably being made by insert-molding plastic onto the rear end of stem portion 253.

Figure 15:
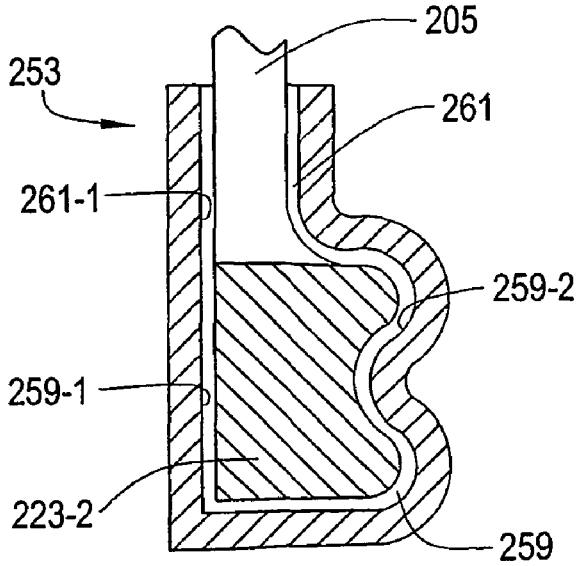
FIG. 15 is a transverse section view of the needle of FIG. 14, the plastic staple of FIG. 13 being shown disposed therein.

Stem portion 253 is similar in many respects to stem portion 103. For example, stem portion 253 is an elongated member terminating at its front end in a spoon-shaped tip 257, tip 257 being sufficiently sharp to enable its penetration into a desired article of commerce. However, as seen best in FIG. 15, stem portion 253 differs primarily from stem portion 103 in that stem portion 253 has a longitudinal bore 259 of a generally "B"-shaped transverse cross-section, instead of the generally semi-elliptical bore 109 of stem portion 103. Bore 259 is bounded on one side thereof by a flat side 259-1 and on an opposite side thereof by a curved or "double-humped" side 259-2. Stem portion 253 defines a longitudinal slot 261 bounded one on side thereof by a flat side 261-1, flat sides 259-1 and 261-1 lying in the same plane and forming a single continuous wall. Bore 259 is appropriately dimensioned to receive a cross-bar of a plastic staple, such as cross-bar 223-2 of plastic staple 221, and slot 261 is appropriately dimensioned to permit a filament, such as filament 205, to extend therethrough while its associated cross-bar is disposed within bore 259. The outer width of stem portion is about 0.042 inch.

Many of the advantages discussed above that result from the use of needle 101 with conventional plastic staples also result from the use of staple 221 and needle 251.

Figure 16:
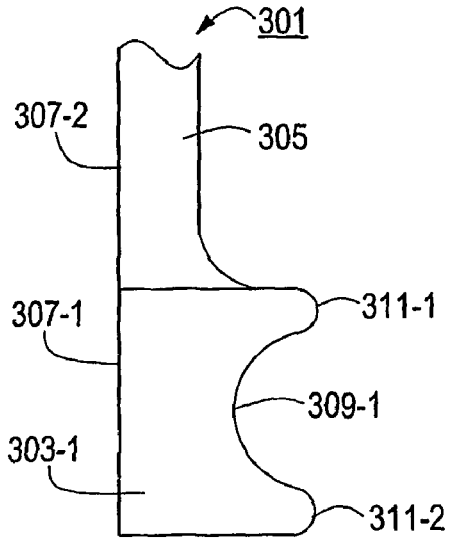
FIG. 16 is a fragmentary end view of a third embodiment of a plastic staple constructed according to the teachings of the present invention.

Referring now to FIG. 16, there is shown a fragmentary end view of a third embodiment of an individual plastic staple constructed according to the teachings of the present invention, said plastic staple being referred to generally by reference numeral 301.

Staple 301 is similar in virtually all respects to staple 221, staple 301 comprising a pair of mirror image cross-bars (only first cross-bar 303-1 being shown) interconnected by a flexible filament 305. As can be seen, cross-bar 303-1 and filament 305 are flat on sides 307-1 and 307-2, with sides 307-1 and 307-2 being coplanar with one another. As can also be seen, cross-bar 303-1 is shaped to include a pair of protrusions or humps 311-1 and 311-2 on opposite side 309-1, humps 311-1 and 311-2 being spaced further apart than the corresponding humps on cross-bar 223.

Figure 17:
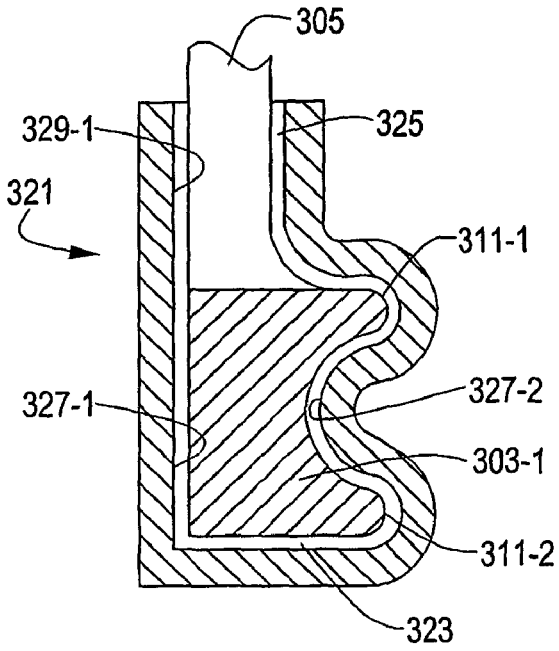
FIG. 17 is a transverse section view of a fourth embodiment of a needle constructed according to the teachings of the present invention, the plastic staple of FIG. 16 being shown disposed therein.

Referring now to FIG. 17, staple 301 is shown inserted into the stem portion 321 of a needle. Stem portion 321 is similar in virtually all respects to stem portion 253 of needle 251, stem portion 321 being an elongated member terminating at its front end in a spoon-shaped tip and being shaped to include a longitudinal bore 323 and a longitudinal slot 325. Bore 323, which has a generally "B"-shaped transverse cross-section, is bounded on one side thereof by a flat side 327-1 and on an opposite side thereof by a curved or "double-humped" side 327-2. Slot 325 is bounded one on side thereof by a flat side 329-1, flat sides 327-1 and 329-1 lying in the same plane and forming a single continuous wall. Stem portion 321 differs from stem portion 253 only in that bore 323 is appropriately shaped to conform to the shape of side 309-1 of cross bar 303-1, as opposed to side 225-4 of cross-bar 223-1.

Figure 18:
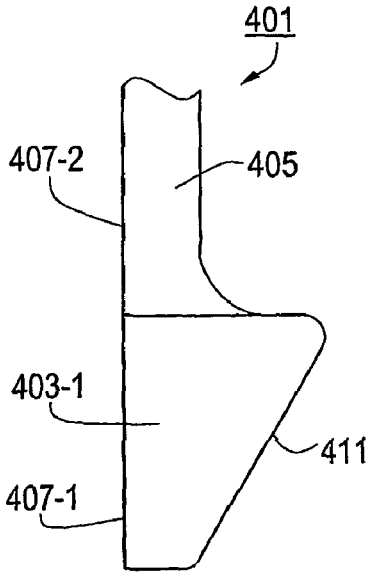
FIG. 18 is a fragmentary end view of a fourth embodiment of a plastic staple constructed according to the teachings of the present invention.

Referring now to FIG. 18, there is shown a fragmentary end view of a fourth embodiment of an individual plastic staple constructed according to the teachings of the present invention, said plastic staple being referred to generally by reference numeral 401.

Staple 401 is similar in many respects to staple 221, staple 401 comprising a pair of mirror image cross-bars (only first cross-bar 403-1 being shown) interconnected by a flexible filament 405. As can be seen, cross-bar 403-1 and filament 405 are flat on sides 407-1 and 407-2, with sides 407-1 and 407-2 being coplanar with one another. As can also be seen, cross-bar 403-1 is shaped to include a sloped side 411 opposite to side 407-1, sloped side 411 giving cross-bar 403-1 a generally wedge-shaped transverse cross-section.

Figure 19:
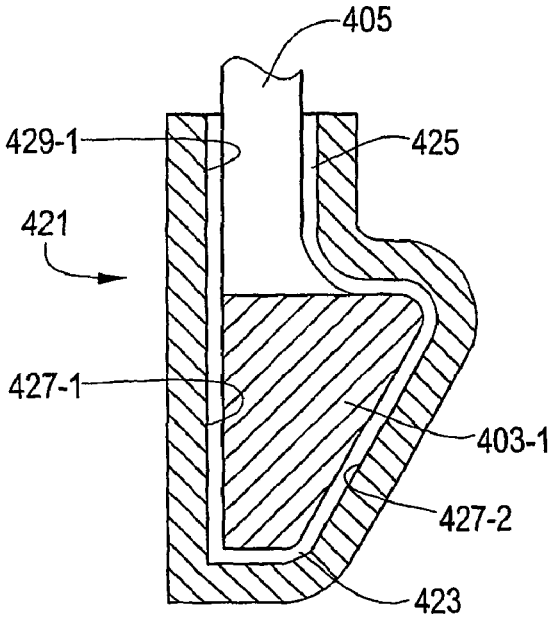
FIG. 19 is a transverse section view of a fifth embodiment of a needle constructed according to the teachings of the present invention, the plastic staple of FIG. 18 being shown disposed therein.

Referring now to FIG. 19, staple 401 is shown inserted into the stem portion 421 of a needle. Stem portion 421 is similar in many respects to stem portion 253 of needle 251, stem portion 421 being an elongated member terminating at its front end in a spoon-shaped tip and being shaped to include a longitudinal bore 423 and a longitudinal slot 425. Bore 423, which has a generally wedge-shaped transverse cross-section, is bounded on one side thereof by a flat side 427-1 and on an opposite side thereof by a sloped side 427-2. Slot 425 is bounded one on side thereof by a flat side 429-1, flat sides 427-1 and 429-1 lying in the same plane and forming a single continuous wall. As can be seen, bore 423 of stem portion 421 is appropriately shaped to conform to the shape of cross bar 403-1.

Figure 20:
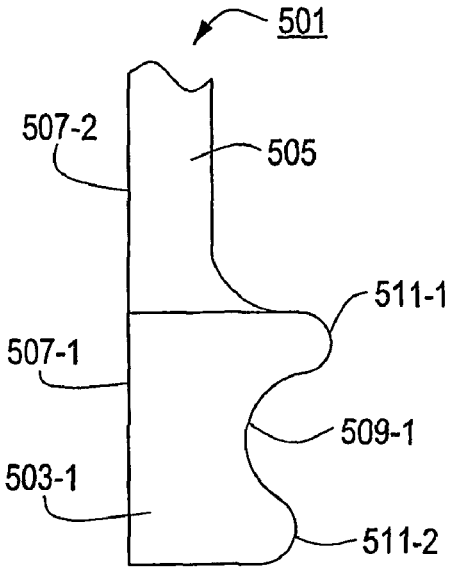
FIG. 20 is a fragmentary end view of a fifth embodiment of a plastic staple constructed according to the teachings of the present invention.

Referring now to FIG. 20, there is shown a fifth embodiment of an individual plastic staple constructed according to the teachings of the present invention, said plastic staple being referred to generally by reference numeral 501.

Staple 501 is similar in virtually all respects to staple 301, staple 501 comprising a pair of mirror image cross-bars (only first cross-bar 503-1 being shown) interconnected by a flexible filament 505. As can be seen, cross-bar 503-1 and filament 505 are flat on sides 507-1 and 507-2, with sides 507-1 and 507-2 being coplanar with one another. As can also be seen, cross-bar 503-1 is shaped to include a pair of protrusions or humps 511-1 and 511-2 on opposite side 509-1, humps 511-1 and 511-2 differing from humps 311-1 and 311-2 of staple 301 in that hump 511-1 protrudes further away from side 507-1 than does hump 511-2.

Figure 21:
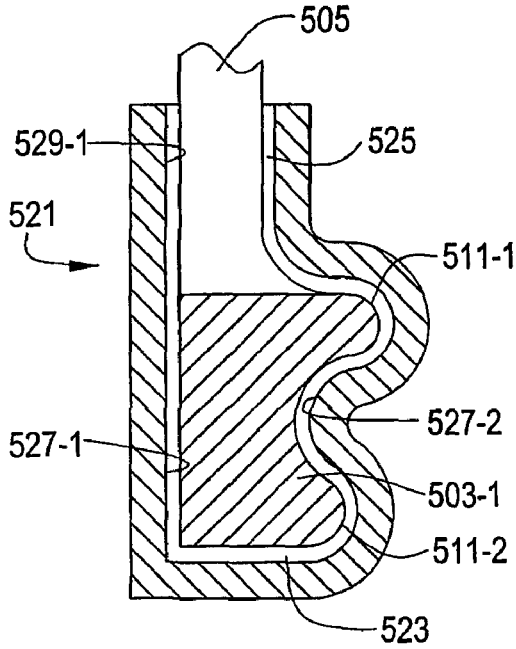
FIG. 21 is a transverse section view of a sixth embodiment of a needle constructed according to the teachings of the present invention, the plastic staple of FIG. 20 being shown disposed therein.

Referring now to FIG. 21, staple 501 is shown inserted into the stem portion 521 of a needle. Stem portion 521 is similar in virtually all respects to stem portion 321, stem portion 521 being an elongated member terminating at its front end in a spoon-shaped tip and being shaped to include a longitudinal bore 523 and a longitudinal slot 525. Bore 523, which has a generally "B"-shaped transverse cross-section, is bounded on one side thereof by a flat side 527-1 and on an opposite side thereof by a curved or "double-humped" side 527-2. Slot 525 is bounded one on side thereof by a flat side 529-1, flat sides 527-1 and 529-1 lying in the same plane and forming a single continuous wall. Stem portion 521 differs from stem portion 321 only in that bore 523 is appropriately shaped to conform to the shape of side 509-1 of cross bar 503-1, as opposed to side 309-1 of cross-bar 303-1.

Figure 22:
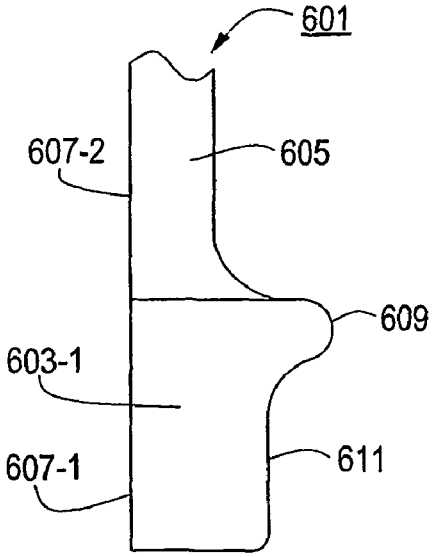
FIG. 22 is a fragmentary end view of a sixth embodiment of a plastic staple constructed according to the teachings of the present invention.

Referring now to FIG. 22, there is shown a fragmentary end view of a sixth embodiment of an individual plastic staple constructed according to the teachings of the present invention, said plastic staple being referred to generally by reference numeral 601.

Staple 601 is similar in many respects to staple 401, staple 601 comprising a pair of mirror image cross-bars (only first cross-bar 603-1 being shown) interconnected by a flexible filament 605. As can be seen, cross-bar 603-1 and filament 605 are flat on sides 607-1 and 607-2, with sides 607-1 and 607-2 being coplanar with one another. As can also be seen, cross-bar 603-1 is shaped to include a protrusion or hump 609 on a side 611 opposite to side 607-1.

Figure 23:
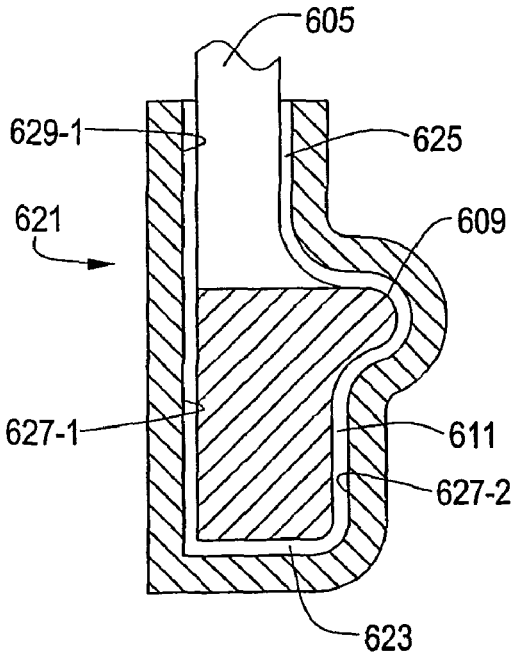
FIG. 23 is a transverse section view of a seventh embodiment of a needle constructed according to the teachings of the present invention, the plastic staple of FIG. 22 being shown disposed therein.

Referring now to FIG. 23, staple 601 is shown inserted into the stem portion 621 of a needle. Stem portion 621 is similar in many respects to stem portion 421, stem portion 621 being an elongated member terminating at its front end in a spoon-shaped tip and being shaped to include a longitudinal bore 623 and a longitudinal slot 625. Bore 623 is bounded on one side thereof by a flat side 627-1 and on an opposite side thereof by a side 627-2 shaped to conform to side 611 of cross-bar 603-1. Slot 625 is bounded one on side thereof by a flat side 629-1, flat sides 627-1 and 629-1 lying in the same plane and forming a single continuous wall.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A length of fastener stock, said length of fastener stock comprising a pair of continuous side members and a plurality of flexible cross-links interconnecting said continuous side members, said flexible cross-links being equidistantly-spaced apart at a pitch of about 0.18 inch, wherein said continuous side members are parallel to one another and are connected to one another only by said flexible cross-links, wherein said flexible cross-links are perpendicular to each of said continuous side members, wherein each of said continuous side members has a flat side, wherein each of said flexible cross-links has a flat side and wherein said flat sides of said continuous side members and said flexible cross-links are coplanar.

2. The length of fastener stock as claimed in claim 1 wherein each of said continuous side members is semi-elliptical in transverse cross-section.

3. The length of fastener stock as claimed in claim 1 wherein at least one of said continuous side members has a second side opposite to said flat side, said second side including at least one hump.

4. An individual plastic fastener separated from the length of fastener stock claimed in claim 1.

5. The individual plastic fastener as claimed in claim 4 wherein said individual plastic fastener comprises a first cross-bar and a flexible filament that are collectively "d"-shaped in transverse cross-section.

6. A length of fastener stock, said length of fastener stock comprising a pair of continuous side members and a plurality of flexible cross-links interconnecting said continuous side members, said flexible cross-links being equidistantly-spaced apart at a pitch of about 0.18 inch, said continuous side members being connected to one another only by said flexible cross-links.

7. The length of fastener stock as claimed in claim 6 wherein said continuous side members are parallel to one another and wherein said flexible cross-links are perpendicular to each of said continuous side members.

* * * * *